US006133891A

United States Patent [19]

Josypenko

[11] Patent Number: 6,133,891

[45] Date of Patent: Oct. 17, 2000

[54] QUADRIFILAR HELIX ANTENNA

[75] Inventor: Michael J. Josypenko, Norwich, Conn.

[73] Assignee: The United States of America as represented by the Secretary of the Navy, Washington, D.C.

[21] Appl. No.: 09/173,612

[22] Filed: Oct. 13, 1998

[51] Int. Cl.[7] ..... H01Q 1/36

[52] U.S. Cl. ..... 343/895; 343/860

[58] Field of Search ..... 343/895, 700 MS, 343/850, 853, 865, 859, 860, 893, 906; H01Q 1/36, 1/38

[56] References Cited

U.S. PATENT DOCUMENTS 4,114,164 9/1978 Greiser ..... 343/895
4,697,192 9/1987 Hofer et al. ..... 343/895
5,313,216 5/1994 Wang et al. ..... 343/700 MS
5,346,300 9/1994 Yamamoto et al. ..... 343/895
5,635,945 6/1997 McConnell et al. ..... 343/895
5,909,196 6/1999 O'Neill ..... 343/895

*Primary Examiner*—Tho Phan
*Attorney, Agent, or Firm*—Michael J. McGowan; Robert W. Gauthier; Prithvi C. Lall

[57] ABSTRACT

A quadrifilar helical antenna is provided having feed points connected to the individual helical antenna elements through a spiral coupling path. The spiral coupling path additionally is wound contrarily to the winding of the helix. Moreover, each path has variable dimensions to provide impedance matching.

20 Claims, 9 Drawing Sheets

QUADRIFILAR HELIX ANTENNA

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION (1) Field of the Invention

This invention generally relates to antennas and more specifically to quadrifilar antennas.

(2) Description of the Prior Art

Numerous communication networks utilize omnidirectional antenna systems to establish communications between various stations in the network. In some networks one or more stations may be mobile while others may be fixed land based or satellite stations. Omnidirectional antenna systems are preferred in such applications because alternative highly directional antenna systems become difficult to apply, particularly at a mobile station that may communicate with both fixed land based and satellite stations. In satellite communication applications it is desirable to provide a unidirectional antenna system that is compact yet characterized by a wideband width and a good front-to-back ratio, i.e., the ratio of overhead power to backside power, such that its pattern ideally only occupies the upper hemisphere.

Some prior art omnidirectional antenna systems use an end fed quadrifilar helix antenna for satellite communication and a co-mounted dipole antenna for land based communications. However, each antenna has a limited bandwidth and collectively their performance can be dependent upon antenna position relative to a ground plane. The dipole antenna tends to have no front-to-back ratio which can cause total pattern cancellation when the antenna is mounted on a ship, particularly over low elevation angles. These co-mounted antennas also have spatial requirements that can limit their use in confined areas aboard ships or similar mobile stations.

The following patents disclose helical antennas that exhibit some, but not all, the previously described desirable characteristics:

U.S. Pat. No. 3,599,220 (1971) Demsey

U.S. Pat. No. 3,623,113 (1971) Faigen et al.

U.S. Pat. No. 4,243,993 (1981) Lamberly et al.

U.S. Pat. No. 4,644,366 (1987) Scholz

U.S. Pat. No. 5,053,786 (1991) Silverman et al.

U.S. Pat. No. 5,134,422 (1992) Auriol

U.S. Pat. No. 5,170,176 (1992) Yasunaga et al.

U.S. Pat. No. 5,343,173 (1994) Balodis et al.

U.S. Pat. No. 5,594,461 (1997) O'Neil, Jr.

U.S. Pat. No. 5,635,945 (1997) McConnell

U.S. Pat. No. 3,599,220 to Dempsey discloses a conical, spiral loop antenna comprising a plurality of pairs of spirally wound radiating arms. The radiating arms are wound in the shape of a cone and terminate at one end in a truncated portion. Impedance matching is provided between each of the pairs of radiating arms at the truncated end. A ground plane is provided for each frequency of operation; multiple ground planes are required for multiple frequencies. The primary purpose of this patent is to provide a compact antenna that is tunable. However, it appears that the antenna is generally tuned for a specific frequency.

U.S. Pat. No. 3,623,113 to Faigen et al. discloses a balanced, tunable, helical mono-pole antenna that operates independently of a ground plane. This antenna utilizes a centrally fed, multiple-turn, helical antenna with a single element. End winding shorting means in the form of "top hat"- or "can"-type housings tune the antenna by changing the active electrical length of the antenna. A feed loop is centrally disposed to the helical mono-pole antenna winding to provide a balanced input to the antenna. Although this antenna is compact and can be tuned through a wide bandwidth, it does not provide an omnidirectional radiation pattern.

U.S. Pat. No. 4,243,993 to Lamberty et al discloses a broad band antenna comprising center fed, spiral antenna arms arranged on planar and conical surfaces. Each antenna arm includes one or more choke elements that resonate at a predetermined operating frequency to eliminate or minimize undesired radiation and reception characteristics and provide sum and difference mode operations with both right-hand and left-hand circularly polarized radiation characteristics. Feeding an antenna as disclosed in the Lamberty et al patent with a phased sequence of signals produces a radiation pattern that exhibits a null along an antenna bore sight axis and a maximum field along a cone of revolution about the bore sight axis. Although this antenna has a broad bandwidth and provides circular polarization, it does not provide an omnidirectional radiation pattern.

U.S. Pat. No. 4,644,366 to Scholz discloses a miniature radio transceiver antenna formed as an inductor wrapped about a printed circuit card. A peripheral conductor on one side of the card provides distributed capacitance to the end of the antenna that cancels inductive effects and broadens bandwidth. A peripheral conductor on the opposite side of the card provides a capacitance to ground to tune the antenna to frequency. An unbalanced transmission line connects between one end of the antenna and a tap or feed point to provide impedance matching and tuning. This antenna has a limited bandwidth for a given connection point. Moreover it does not produce an omnidirectional radiation pattern.

U.S. Pat. No. 5,053,786 to Silverman et al. discloses a broad band directional antenna in which two contiguous conductive planar spirals are fed at their center. The antenna is positioned near a cavity to absorb rear lobes in order to improve the front-to-back ratio. Even with this improvement in the front-to-back ratio, the antenna provides a relatively narrow beam pattern having both horizontal and vertical polarization. Apparently, this antenna is designed to operate with a linearly polarized, high gain, narrow beam. Thus the antenna does not provide an omnidirectional radiation pattern or circular polarization. Moreover, by absorbing the rear lobes, the power transmitted into the reserve lobes is lost making the antenna less efficient in radiating during a transmitting mode.

U.S. Pat. No. 5,134,422 to Auriol discloses an antenna with helically wound, equally spaced, radiating elements disposed on a cylindrical surface. Antennas identified as prior art antennas in this reference include helically wound, end driven antenna elements. The other ends of the elements terminate as open circuits. These antennas provide circular polarization, an omnidirectional radiation pattern and a good front-to-back ratio. The Auriol patent is particularly directed to a structure that uses a conductive, meandering strip to connect the driven ends and establish various phase relationships and tuning. This antenna is designed to produce high quality circular polarization, an omnidirectional radiation pattern and a good front-to-back ratio, but only over a narrow frequency band.

In U.S. Pat. No. 5,170,176 (1992) to Yasunaga et al. a quadrifilar helix antenna includes four helix conductors wound around an axis in the same winding direction. Each helix conductor has a linear conductor which is parallel to its axis at either end or both ends of the helix conductor. The purpose of this structure is to reduce the effect of multipath fading due to sea-surface reflection in mobile satellite communications. Although this patent discloses an antenna that provides good front-to-back ratio, the transmission pattern from the antenna is also characterized by essentially forming two major lobes about 60° from the forward direction so it is not truly omni-directional over a hemisphere.

U.S. Pat. No. 5,343,173 (1994) to Balodis et al. discloses a phase shifting network and antenna including a series of helical antenna elements with a phase shifting network defining transmission paths between a radio connection terminal and the antenna elements. Each transmission path phase shifts the signal relative to an adjacent path pairs that are progressively joined at combiner nodes of equal power division by shunt connection line segments.

U.S. Pat. No. 5,594,461 (1997) to O'Neill, Jr. discloses a low loss quadrature matching network for a quadrifilar helix antenna. As in the above-identified Balodis et al. patent, the O'Neill, Jr. patent utilizes microstrip techniques to provide impedance matching in an antenna system.

U.S. Pat. No. 5,635,945 (1997) to McConnell et al. discloses a quadrifilar helix antenna with four conductive elements arranged to define two separate helically twisted loops, one differing slightly in electrical length from the other. The two separate helically twisted loops are connected to each other in a way as to provide impedance matching, electrical phasing, coupling and power distribution for the antenna. The antenna is fed at a tap point on one of the conductive elements determined by an impedance matching network which connects the antenna to a transmission line. Like to foregoing Balodis et al. and O'Neill, Jr. patents, this patent also utilizes microstrip techniques to feed and match through a partly balanced transmission line. As a result the resultant band width is narrow.

The following patent discloses a broadband antenna system:

U.S. Pat. No. 5,257,032 (1993) Diamond et al.

This broadband antenna system includes a frequency-independent antenna coupled to the frequency-dependent antenna, specifically, a spiral antenna and a dipole antenna. In one embodiment the antenna system comprises a dipole or monopole coupled to the inner or outer termination points of a spiral antenna. The spiral antenna acts as a broadband transmission line matching section and adds electrical length to the monopole antenna. Thus, the spiral antenna is stated to minimize the negative effects typically associated with the removal of one of the elements of a stand alone dipole antenna to create a monopole antenna. It is believed that when the dipole antenna is added to the termination points of the spiral antenna, the resulting antenna system extends the low frequency capability of the spiral antenna for linear polarization. It is also felt that the spiral antenna adds electrical length to the dipole antenna and acts as a broadband transmission line matching section so that the spiral antenna enhances receiving capability by producing a maximum signal at the transmission lines. This patent discloses the combination of two types of antennas. However, the combination includes a spiral antenna and either a monopole or dipole antenna. It also appears that the antenna system is directional and not omni-directional over both a broad frequency band and over a hemispherical volume.

Thus there exists a family of quadrifilar helixes that are broadband impedance wise above a certain "cut-in" frequency, and thus are useful for wideband satellite communication (DAMA function of 240 to 320 MHz, other functions at 320 to 410 MHz). Typically these antennas have:

1. a pitch angle of the elements on the helix cylindrical surface from 50° down to roughly 20°;
2. elements that are at least roughly ¾ wavelengths long; and
3. a "cut-in" frequency roughly corresponding to when a turn of an element on the helix cylinder is ½ wavelength long. (This dependence changes some with pitch angle. Above the "cut-in" frequency, the helix has an approximately flat VSWR, around 2:1 or less about the $Z_o$ value of the antenna, and thus the antenna is broadband impedancewise above "cut-in".)

The previous three dimensions translate into a helix diameter of 0.1 to 0.2 wavelengths at "cut-in".

For pitch angles of approximately 30° to 50°, good cardoid shaped patterns exist for satellite communications. Good circular polarization exists down to the horizon since the antenna is greater than 1.5 wavelengths long (2 elements constitute one array of the dual array, quadrifilar antenna) and is at least one turn. At the "cut-in" frequency, the lower pitch 17 angled helixes have sharper patterns. As frequency increases, patterns start to flatten overhead and spread out near the horizon. For a given satellite band to be covered, a tradeoff can be chosen on how sharp the pattern is allowed to be at the bottom of the band and how much it can be spread out by the time the top of the band is reached. This tradeoff is made by choosing where the band should start relative to the "cut-in" frequency and by choosing the pitch angle.

For optimum front-to-back ratio performance, the bottom of the band should start at the "cut-in" frequency. This is because for a given element thickness, backside radiation increases with frequency (the front-to-back ratio decreases with frequency). This decrease of front-to-back ratio with frequency limits the antenna immunity to multipath nulling effects.

SUMMARY OF THE INVENTION

Therefore it is an object of this invention to provide a broad band unidirectional hemispherical coverage antenna.

Another object of this invention is to provide a broad band unidirectional hemispherical coverage antenna with good front-to-back ratio.

Yet another object of this invention is to provide a broad band unidirectional hemispherical coverage antenna that operates with circular polarization.

Yet still another object of this invention is to provide a broad band unidirectional hemispherical coverage antenna that operates with a circular polarization and that exhibits a good front-to-back ratio.

Yet still another object of this invention is to provide a broad band unidirectional hemispherical coverage antenna that is simple to construct.

In accordance with this invention, a helical antenna includes a plurality of antenna elements supported as spaced helices along an antenna axis. Antenna feed points are located proximate the antenna axis at a first end of the helices. A spiral connector between each antenna element and one of the antenna feed points is located between each antenna element and one of the antenna feed points. These spiral connectors lie in a transverse plane at one end of the helices.

In accordance with another object of this invention a quadrifilar helical antenna operates over a frequency bandwidth defined by a minimum operating frequency and includes a cylindrical support extending along an antenna axis between first and second ends thereof. The cylindrical support carries four equiangularly spaced helical antenna elements each having a length of at least ¾ wavelength of the antenna minimum operating frequency. A planar feed end support is located at the first end of the antenna and transverse to the cylindrical support for defining a feed point for each antenna element. Four conductors are arranged in spiral paths that are oppositely wound from the helical antenna elements. Each conductor connects between a feed point and a corresponding antenna element. A pair of radially opposite conductors constitutes a transmission line, thus four conductors, or two pairs constitute two transmission lines. The two transmission lines are fed in phase quadrature at the antenna feed point.

BRIEF DESCRIPTION OF THE DRAWINGS

The appended claims particularly point out and distinctly claim the subject matter of this invention. The various objects, advantages and novel features of this invention will be more fully apparent from a reading of the following detailed description in conjunction with the accompanying drawings in which like reference numerals refer to like parts, and in which:

DESCRIPTION OF THE PREFERRED EMBODIMENT

Figure 1:
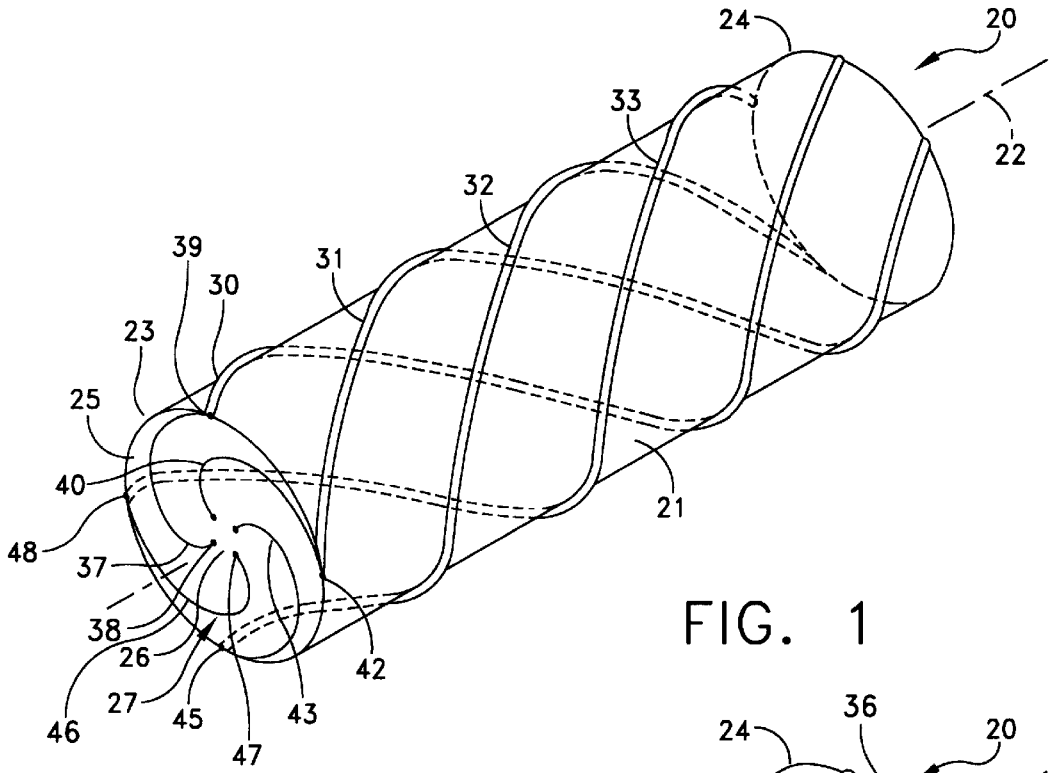
FIG. 1 depicts an antenna system constructed in accordance with this invention for operating in an open mode.

FIG. 1 depicts, in schematic form, an antenna 20 constructed in accordance with this invention. A cylindrical support 21 extends along a longitudinal antenna axis 22 between a first or feed end 23 and a second or distal end 24. The cylindrical support 21 is composed of an insulating material that exhibits low losses at the RF frequencies involved, namely between 200 and 500 MHz.

The support additionally includes a planar support 25 at a feed end 23 that is transverse to the cylindrical support 21 and the antenna axis 22. The planar support 25 is also made of a low loss insulating material. The planar support 25 includes an antenna feed point shown generally at 26, for receiving signals from a transmitter or transferring received signals to a receiver (not shown) in quadrature phase and an array 27 of spiral conductors.

In accordance with this invention, the antenna support 21 carries an even number of equiangularly spaced helically wrapped antenna elements 30, 31, 32 and 33, respectively. Typically the plurality will be constituted by four such conductors. Each of the equiangularly spaced elements 30 through 33 will have a length exceeding three-quarters of a wave length (i.e., ¾ λ min) at a minimum operating frequency.

Figure 2:
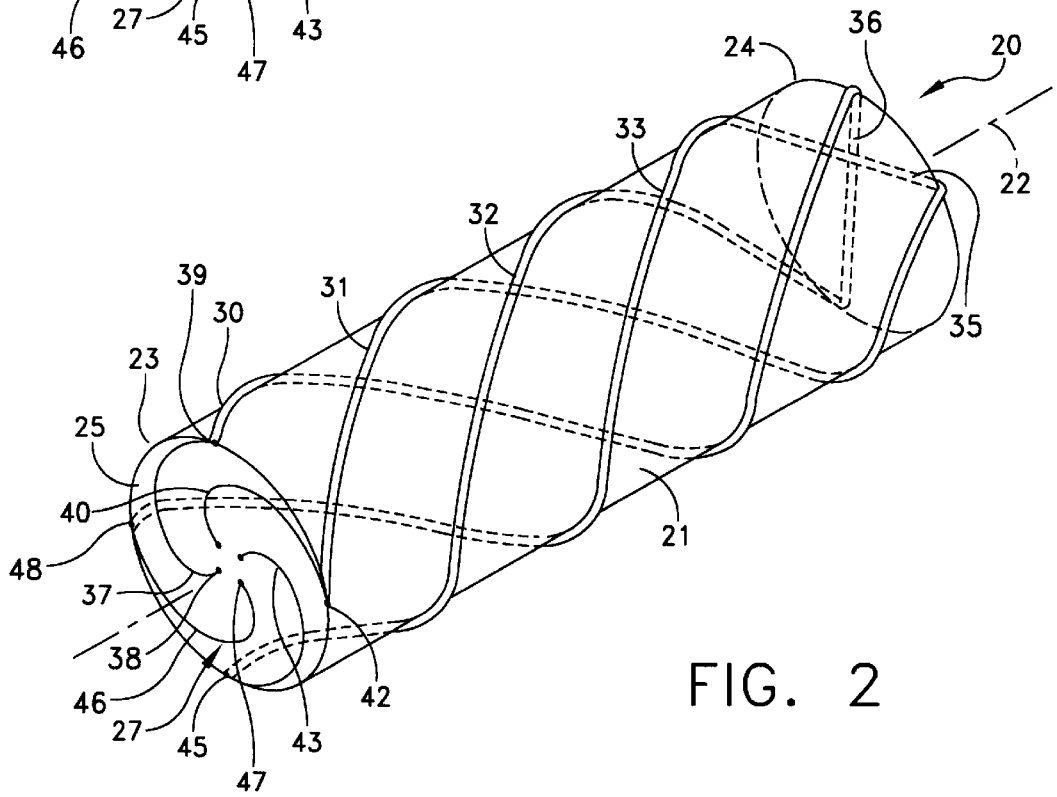
FIG. 2 depicts an antenna system constructed in accordance with this invention for operating in a shorted mode.

In FIG. 1, each of the antenna elements 30 through 33 terminates in an open circuit at the distal end 24. FIG. 2 depicts the antenna of FIG. 1 with the addition of shorting conductors at the distal end. That is, a diametrically disposed conductor 35 interconnects the distal ends of the antenna elements 31 and 33 and a corresponding diametrically disposed conductor 36 interconnects the distal ends of the antenna elements 30 and 32. As known, but not specifically shown in FIG. 2, the conductors 35 and 36 will be insulated from each other.

Figure 3:
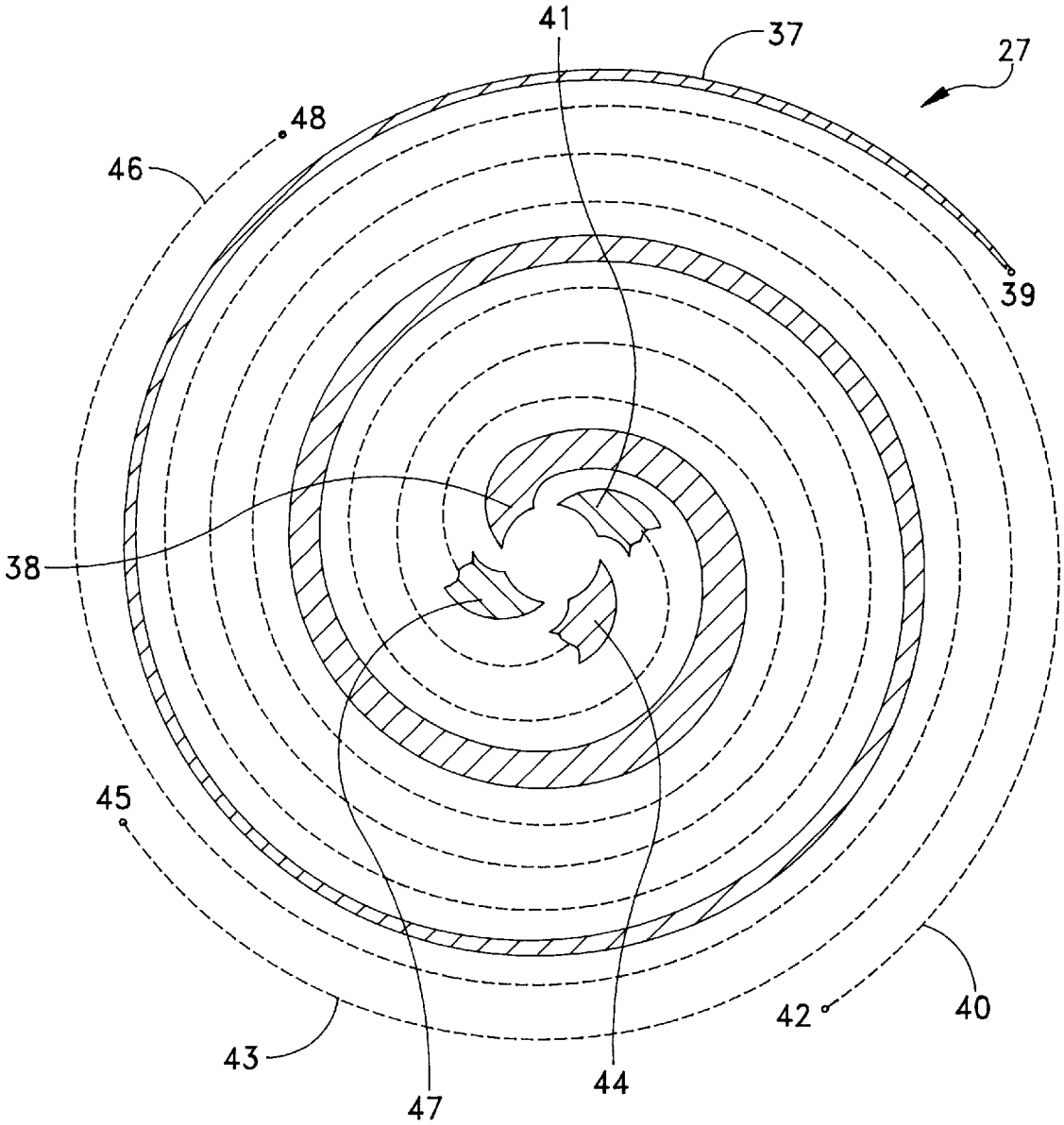
FIG. 3 depicts a transverse section of a particular embodiment of spiral feed point connectors shown in FIG. 1.

Referring to FIGS. 1, 2 and 3, the array 27 at the feed end 23 depicts four spiral conductor paths between the feed point 26 and the conductors. In the embodiment of FIG. 3 a spiral connector 37 extends between an antenna feed point 38 for about two and one-half turns to an antenna element connection 39 with an overall length of at least one-half wavelength at the minimum operating frequency (i.e., 0.5 λmin). Other spiral connectors are shown in partial detail. The result is that each spiral conductor, such as conductor 37, connects between an antenna feed point and a connection at an antenna element. Each pair of radially opposite spiral conductors, i.e., (37;43) and (40,46), constitutes a transmission line, designated T1 and T2, respectively. Thus, the four spiral conductors constitute two transmission lines that are crossed. For the antenna of FIG. 3, the connections are as follows:

| Feed Point Phase | Transmission Line | Spiral Conductor | Antenna Feed Point | Antenna Element | Antenna Element Connection |
|---|---|---|---|---|---|
| 0° | T1 | 37 | 38 | 30 | 39 |
| 270° | T2 | 40 | 41 | 31 | 42 |
| 180° | T1 | 43 | 44 | 32 | 45 |
| 90° | T2 | 46 | 47 | 33 | 48 |

Each of the spiral conductors lies along an Archimedean or equiangular spiral path. As is also particularly evident from conductor 37 in FIG. 3, the volume of the conductor increases from the antenna element connection 39 to the antenna feed point 38. Each of the other spiral conductors 40, 43 and 46 have the same characteristic. That is, the volume increases from the outside of the spiral where the connections are made to the antenna elements to the inside of the spiral where each of the conductors attaches as an antenna feed point. The increase in volume may be constituted merely by an increase in width or by an increase in thickness or both. Consequently the input impedance at the antenna element connections (39, 45) and (42, 48) of the spiral transmission lines T1 and T2 will match the input impedance to the antenna elements (30, 32) and (31, 33) while the input impedance at the antenna feed points (38, 44,) and (41, 47) will match the impedance of the two transmission lines (not shown) feeding the RF energy to the antenna. Processes for performing this matching operation by microstrip technology are well known in the art.

The variation in volume is depicted as a linear function in FIG. 3. The variation could be exponential or follow other mathematical rules. Moreover, in FIG. 3, the conductors could have a variable width and constant thickness.

Figure 4:
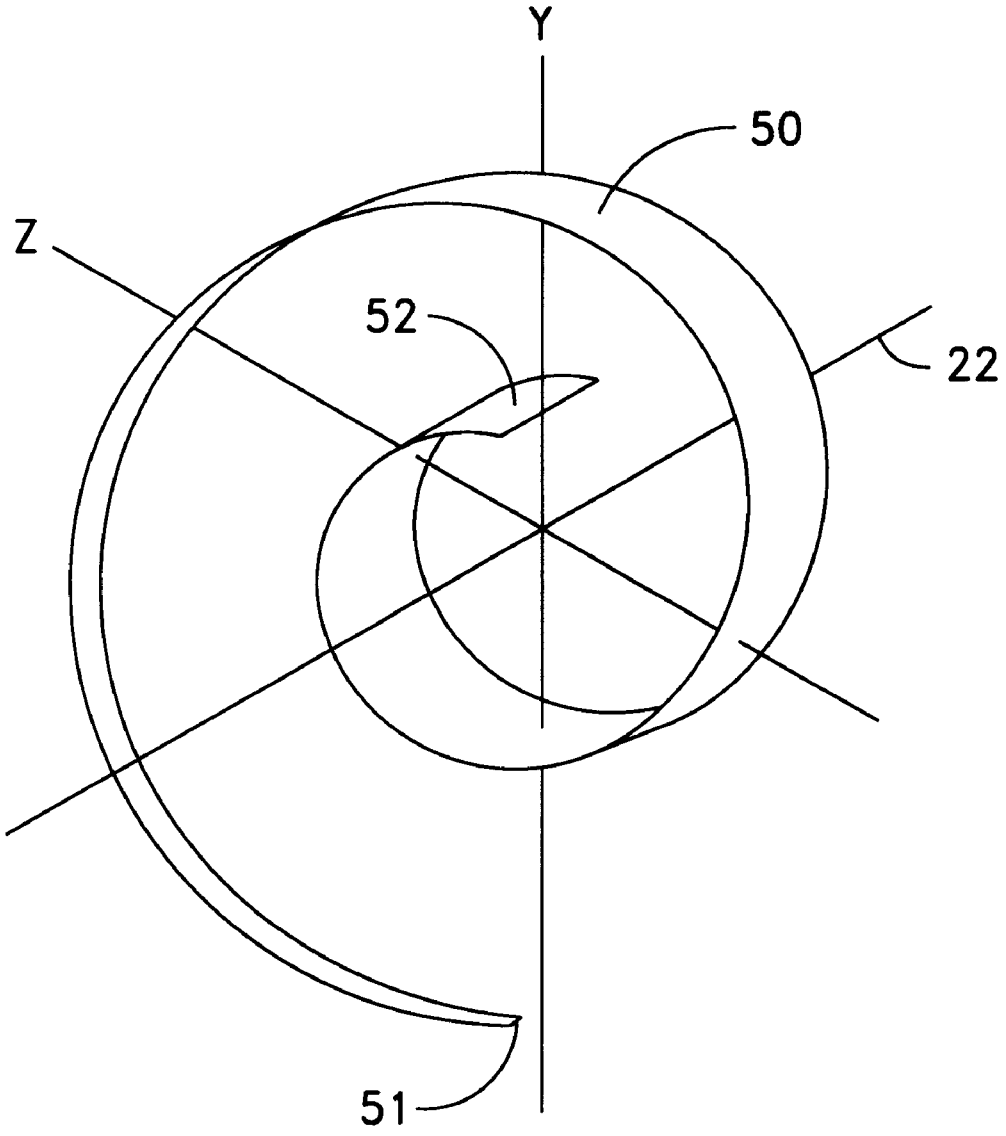
FIG. 4 depicts another embodiment of a spiral conductor useful in the connector of FIG. 1.

At the antenna feed point 26, the structure shown in FIG. 3 has a practical lowest input impedance of about 100 ohms, which feeds nicely into the balanced 100 ohm port of a 50 to 100 ohm, 180° power splitter (not shown). Two such splitters connected to a 90° power splitter will allow a 50 ohm line to connect to the antenna in phase quadrature. An alternative spiral that can obtain exactly 100 ohms or much lower values of input impedance is shown in FIG. 4. The spiral is converted to three dimensions having conductors that have a variable depth along the helix axis 22. In such a structure an air foam spacer would separate the conductors. The conductor 50 would have a high impedance at an end 51 and a low impedance at an end 52. This is believed to provide more evenly spaced current distributions across the element surface, thereby reducing ohmic loss in the signal and consequently producing lower antenna losses.

As shown in FIGS. 1 and 2, the current path through the spiral connector array 27 and the current path through the antenna elements 30 through 33 are in reverse directions when viewed along the antenna axis 22. That is, viewed from the feed end 23, the current paths for the array are clockwise about the axis while the current paths for the antenna elements 30 through 33 are counterclockwise. This reverse direction is important in that backside radiation increases as the elements are changed from reverse spiral arms to radial arms to same direction spiral arms. It is believed that the small amount of circular polarized radiation produced on the backside of the antenna pattern by the helical elements is canceled to a large extent by circular polarized radiation in the opposite direction produced by connector array 27.

The performance and improvements over prior art antennas can be better appreciated by referring to the following example: An antenna according to this invention has the cylindrical support of a 9" diameter and 39.25" length. The diameter of the antenna elements 30 through 33 is 0.5 inches and the pitch angle for these elements is 42.50°. Each spiral element, such as element 31, is formed of a 0.003" copper tape laid on a 0.003" mylar substrate. The prior art example has the same construction except for the spiral conductors. In the prior art example the interconnection from the feed point 26 to each antenna element is a radial feed path, such as shown in U.S. Pat. No. 5,635,945. For the above example, the RF frequencies involved are between 200 and 500 MHz. Changing the size of the antenna will allow other frequency ranges.

Figure 5:
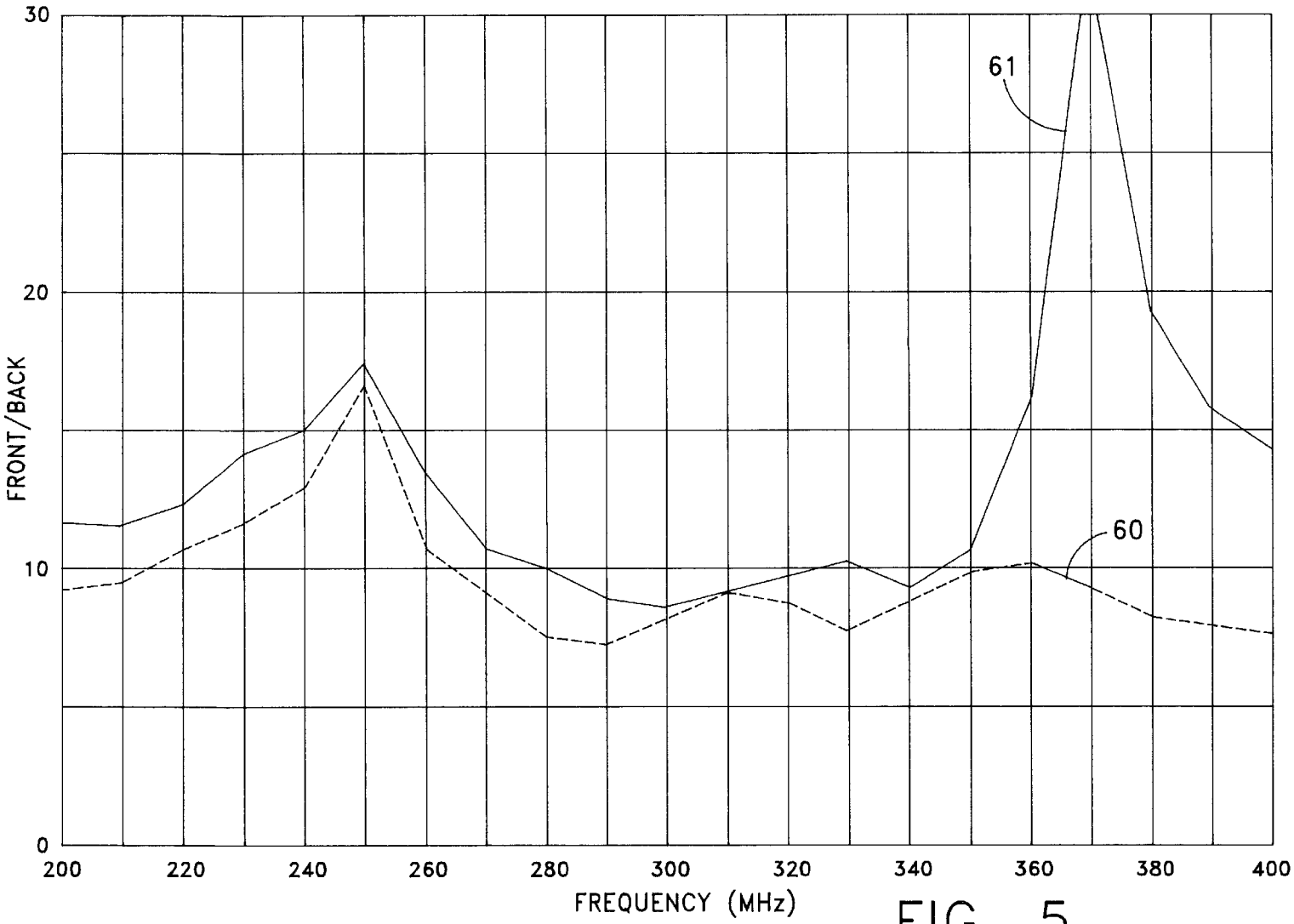
FIGS. 5 through 8 provide comparisons of the front/back ratios of a prior art antenna and an antenna constructed in accordance with this invention in horizontal and vertical polarization and in open and shorted operating modes.

FIG. 5 compares the horizontal polarization front-to-back ratios of the spiral fed, open-ended antenna shown in FIG. 1 fed in backfire mode, i.e., the main pattern beam comes off of the feed and of the antenna, to the performance of a prior art system wherein the spiral feed is replaced by radial feeds. Specifically, Graph 60 in FIG. 5 depicts the radially-fed prior art antenna to the performance of the spiral fed open-ended antenna represented by Graph 61. It will be apparent that the front-to-back ratio is improved over the entire frequency band represented in FIG. 4 from 200–400 MHz.

Figure 6:
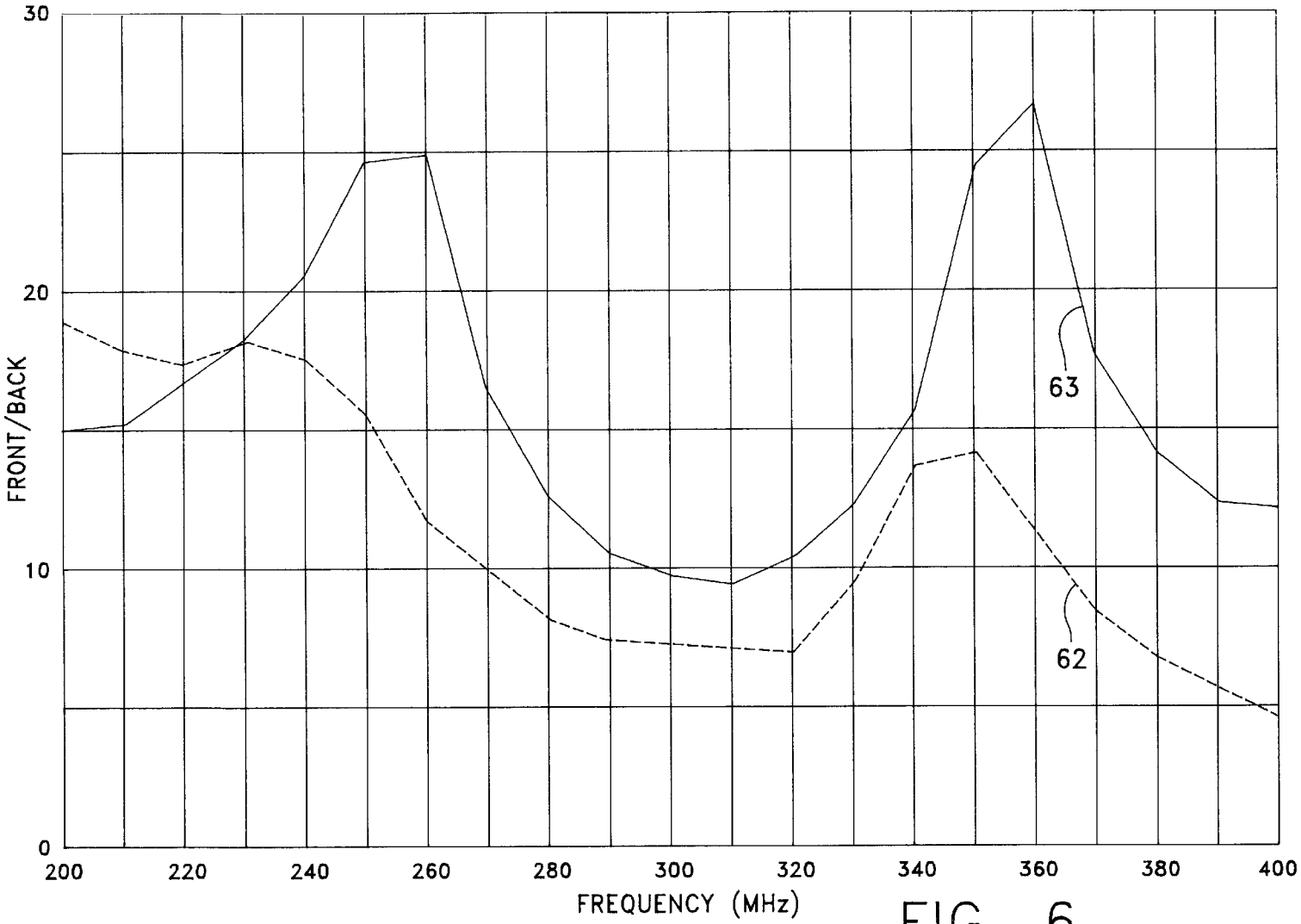

FIG. 6 provides a similar comparison with vertical polarization. In FIG. 6 Graph 62 represents the radial-fed antenna and Graph 63 represents the front-to-back ratios for the spiral fed antenna of FIG. 1. With the exception of a portion of the low end of the frequency range (i.e, 200–230 MHz) front-to-back ratios are improved over the entire range of the frequencies.

Figure 7:
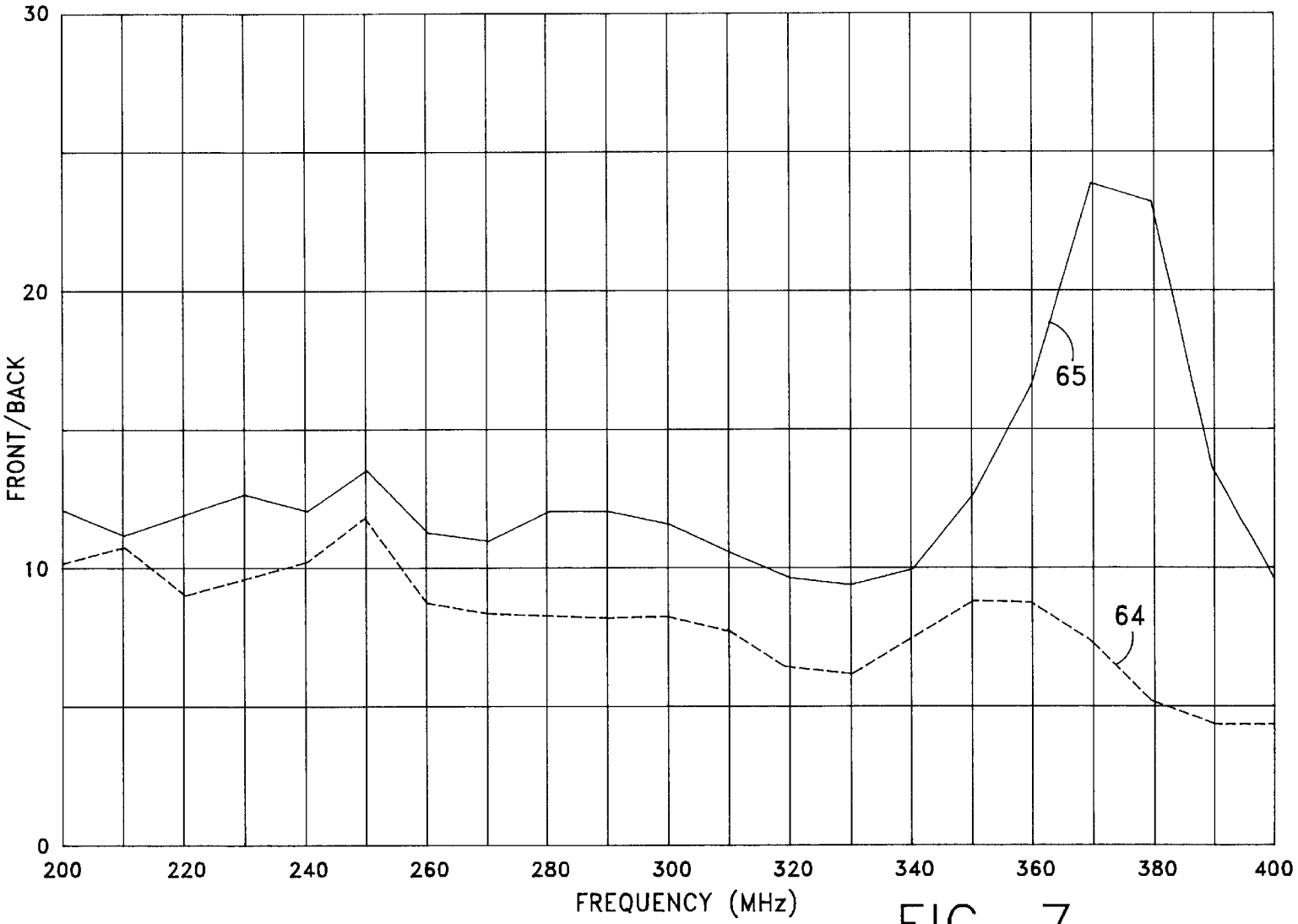
Figure 8:
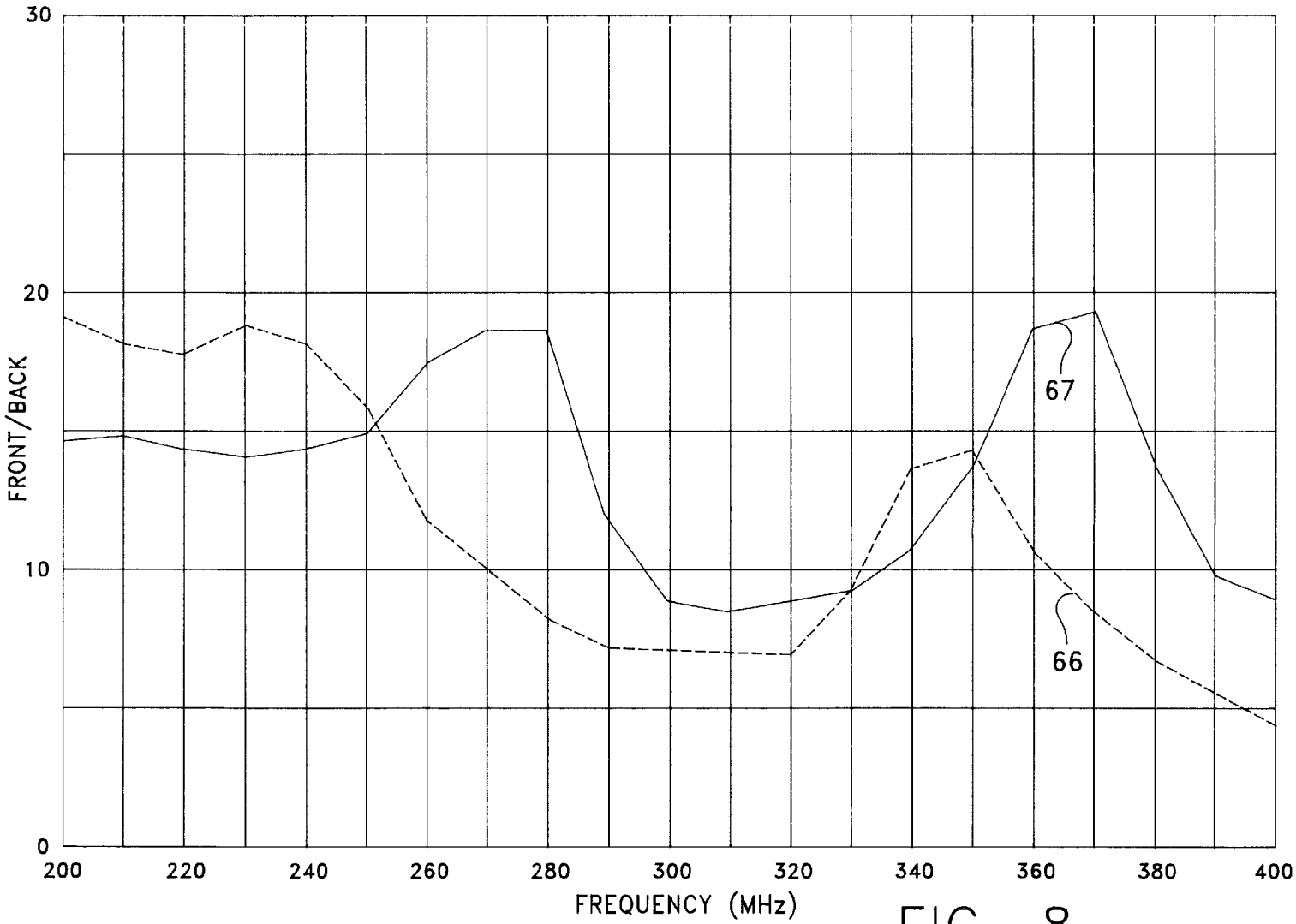

FIG. 7 compares the spiral fed, shorted antenna of FIG. 2 with a comparable prior art antenna in which the spiral feeds are replaced with radial feeds. More particularly, FIG. 7 depicts the front-to-back ratios for horizontally polarized signals and FIG. 8 for vertically polarized signals. In FIG. 7 graph 64 represents front-to-back ratios for the prior art antenna; graph 65 for the antenna of FIG. 2. In FIG. 8, graph 66 represents front-to-back ratios for the prior art antenna; graph 67 for the antenna of FIG. 2. Both these graphs demonstrate that front-to-back ratios are improved over the entire spectrum by the application of this invention.

Figure 9:
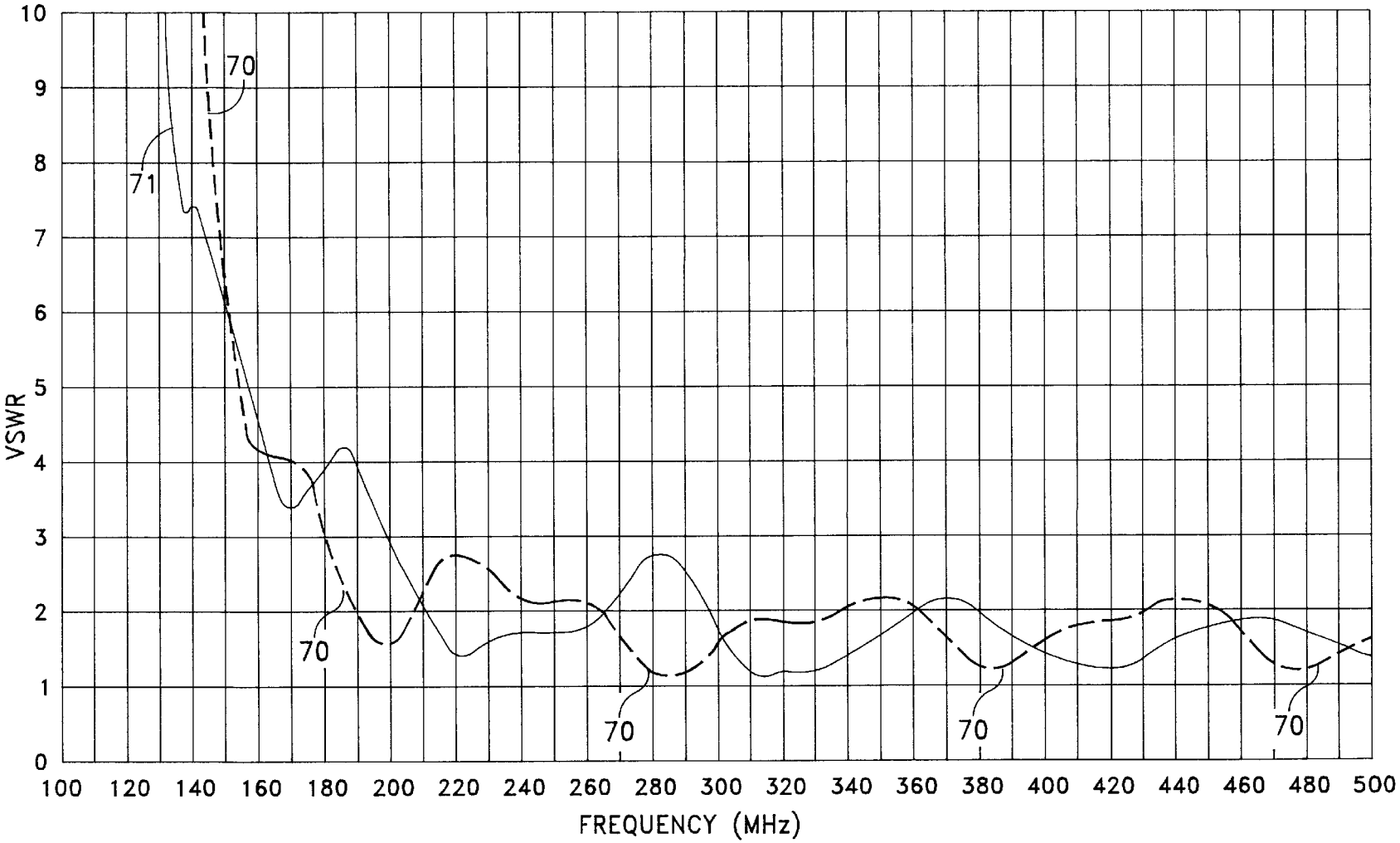
FIG. 9 depicts the voltage standing wave ratio (VSWR) of an antenna constructed in accordance with this invention operating in the open and shorted modes.

FIG. 9 depicts the VSWR of the antenna as shown in FIGS. 1 and 2. Graph 70 depicts the VSWR of the antenna in FIG. 1; Graph 71, the antenna in FIG. 2. The VSWR reaches an acceptable level at about 200 MHz and remains at acceptable levels to at least 500 MHz. In addition, it will be apparent that whether the antennas are operated in the open or shorted forms of FIGS. 1 and 2 the VSWR's have about the same values. Therefore, antenna performance from this aspect seems unaffected by being in the open or shorted versions.

Figure 10:
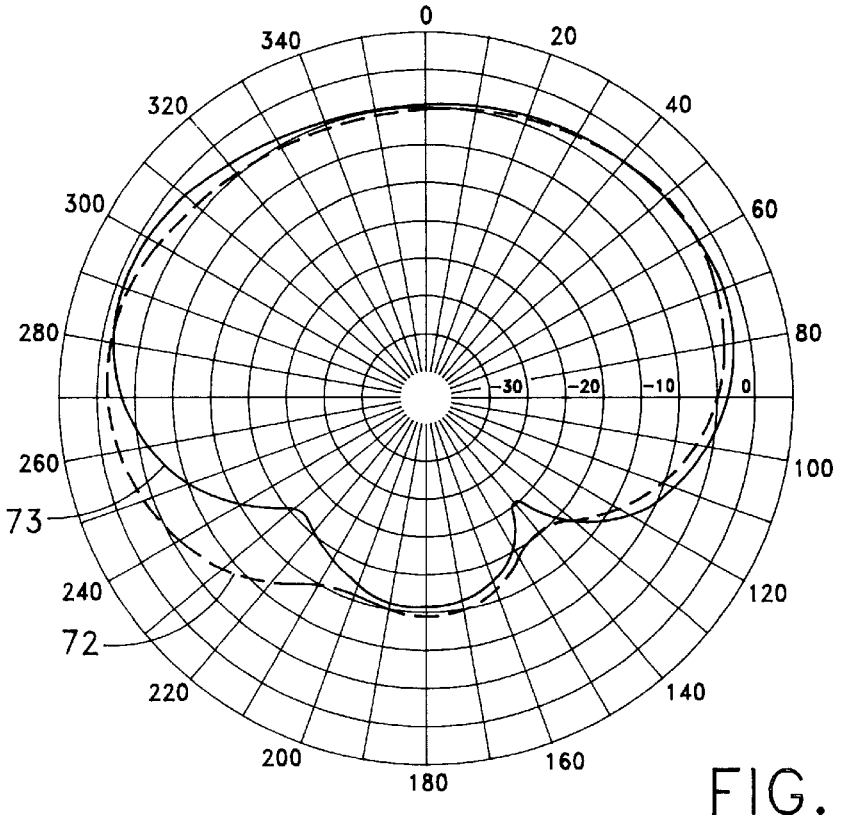
FIGS. 10 and 11 depict the radiation patterns for horizontally and vertically polarized signals, respectively, to compare the patterns from an antenna embodying this invention. and the corresponding prior art antenna.
Figure 11:
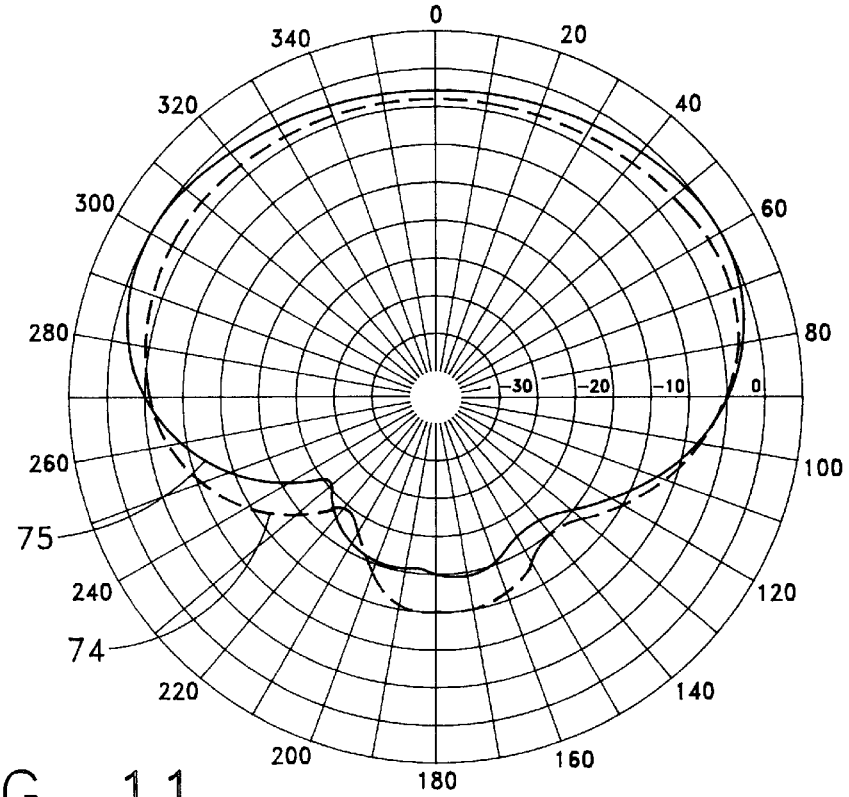

FIGS. 10 and 11 compare sample radiation patterns for the antennas in FIGS. 1 and 2 for both horizontal and vertical polarizations at 270 MHz. More specifically, FIG. 10 depicts the patterns for horizontal polarization, Graph 72 depicting the radiation pattern for the prior art antenna and Graph 73 the antenna of FIG. 1. In FIG. 11, Graph 74 depicts the radiation pattern for vertically polarized signals for the prior art antenna and Graph 75 for the antenna in FIG. 1. These comparisons show that most of the radiation from the antenna is in the forward direction. Moreover, the comparisons show that at this particular frequency the front-to-back ratios, i.e., the ratio of gain at 0° to gain at 180°, are improved throughout. Further, analyses for other frequencies depict that this characteristic continues throughout the spectrum.

In summary, the antennas depicted schematically in FIGS. 1 and 2 operate as do prior art antennas over a wide frequency range with acceptable levels of VSWR in both an open mode and shorted mode. However, the antennas of the present invention improve front-to-back ratios are improved essentially over the entire frequency range in all modes and in both horizontal and vertical polarizations. Moreover, the radiation patterns from these are improved. It will be apparent that this antenna has been described with respect to two particular embodiments and again in schematic form. This specific implementation of this invention may take different forms. Particularly, several alternative methods for feeding the antenna elements through the spiral path have been disclosed. It is the object of the appended claims to cover all such variations and modifications as come under the true spirit and scope of this invention.

What is claimed is:

1. A helical antenna comprising:

a given plurality of antenna elements supported as spaced helices along an antenna axis;

antenna feed points proximate the antenna axis at a first end of the helices; and a spiral conductor line between each antenna element and one of said antenna feed points for providing an impedance matching signal path, said spiral conductor lines lying in a common plane transverse to the antenna axis.

2. A helical antenna as recited in claim 1 wherein said given plurality of antenna elements is an even number whereby a pair of antenna elements terminate with free ends at a second end of the helices at diametrically opposed positions.

3. A helical antenna as recited in claim 2 additionally comprising a connector for electrically connecting each pair of diametrically opposed free ends at the second end of the helices.

4. A helical antenna as recited in claim 1 wherein each spiral conductor line has a variable cross section along its length.

5. A helical antenna as recited in claim 4 wherein said variable cross section diminishes linearly from said feed point to its respective antenna element.

6. A helical antenna as recited in claim 4 wherein said variable cross section diminishes exponentially from said feed point to its respective antenna element.

7. A helical antenna as recited in claim 4 wherein said variable cross section has a constant dimension in one plane and a variable dimension in an orthogonal plane.

8. A helical antenna as recited in claim 7 wherein each said spiral conductor line has a constant thickness parallel to the antenna axis and a variable width in the transverse plane.

9. A helical antenna as recited in claim 7 wherein each said spiral conductor line has a constant width in the transverse plane and a variable thickness parallel to the antenna axis.

10. A helical antenna as recited in claim 1 wherein:

each said antenna element has a length of at least ¾ of a wavelength of the minimum antenna operating frequency; and each said spiral conductor line has a length of at least ½ wavelength of the minimum antenna operating frequency.

11. A helical antenna as recited in claim 1 wherein said plurality of antenna elements is an even number whereby a pair of antenna elements are connected to spiral conductor lines at diametrically opposed positions.

12. A helical antenna as recited in claim 11 further comprising a plurality of transmission lines, each transmission line connected to a pair of antenna feeds corresponding to the diameterically opposed pair of antenna elements, wherein each corresponding pair of spiral conductor lines has a configuration that provides a first characteristic impedance that matches a characteristic impedance of the corresponding antenna elements at the connections thereto and further provides a second characteristic impedance for matching a characteristic impedance of the transmission line connected thereto.

13. A quadrifilar helical antenna for operating over a frequency bandwidth defined by a minimum operating frequency comprising:

a cylindrical support extending along an antenna axis between first and second ends thereof;

four equiangularly spaced helical antenna elements extending along said support, each said antenna element having a length of at least ¾ wavelength of the antenna minimum operating frequency;

a planar feed end support at the first end of and transverse to said cylindrical support for defining a feed point for each antenna element;

four conductors arranged in spaced spiral paths, said spiral being oppositely wound from said helical antenna elements, each said conductor connecting between a feed point and a corresponding antenna element.

14. A quadrifilar helical antenna as recited in claim 13 wherein each antenna element extends to a free end adjacent the second end of said cylindrical support.

15. A quadrifilar helical antenna as recited in claim 14 additionally comprising a connector for electrically connecting each pair of diametrically opposed free ends.

16. A quadrifilar helical antenna as recited in claim 13 wherein each of said spiral conductors has a cross-section that varies diminishingly from said feed point to its respective antenna element.

17. A quadrifilar helical antenna as recited in claim 16 wherein each of said spiral conductors has a cross-section that varies in a dimension parallel to said antenna axis.

18. A quadrifilar helical antenna as recited in claim 16 wherein each of said spiral conductors has a cross-section that varies in a dimension parallel to said antenna axis.

19. A quadrifilar helical antenna as recited in claim 13 wherein each of said spiral conductors has a cross-section that varies linearly, the cross-section diminishing from said feed point to its respective antenna element.

20. A quadrifilar helical antenna as recited in claim 13 wherein each of said spiral conductors has a cross-section that varies diminishes exponentially, the cross-section diminishing from said feed point to its respective antenna element.

* * * * *